US010665945B2

(12) United States Patent
Belot et al.

(10) Patent No.: US 10,665,945 B2
(45) Date of Patent: May 26, 2020

(54) MILLIMETER-WAVE WAVEGUIDE

(71) Applicant: Commissariat à l'Énergie Atomique et aux Énergies Alternatives, Paris (FR)

(72) Inventors: Didier Belot, Rives (FR); Baudouin Martineau, Grenoble (FR)

(73) Assignee: Commissariat á l'Énergie Atomique et aux Énergies Alternatives, Paris (FR)

( * ) Notice: Subject to any disclaimer, the term of this patent is extended or adjusted under 35 U.S.C. 154(b) by 0 days.

(21) Appl. No.: 15/693,667

(22) Filed: Sep. 1, 2017

(65) Prior Publication Data

US 2018/0069315 A1 Mar. 8, 2018

(30) Foreign Application Priority Data

Sep. 6, 2016 (FR) ..... 16 58257

(51) Int. Cl.
*H01Q 1/38* (2006.01)
*H01Q 9/04* (2006.01)
*H01P 3/16* (2006.01)

(52) U.S. Cl.
CPC ..... *H01Q 9/0407* (2013.01); *H01P 3/16* (2013.01); *H01Q 1/38* (2013.01)

(58) Field of Classification Search
CPC ..... H01Q 9/0407; H01Q 1/38; H01P 3/165
See application file for complete search history.

(56) References Cited

U.S. PATENT DOCUMENTS 4,465,336 A 8/1984 Huber et al.
6,104,264 A 8/2000 Ishikawa et al.
7,209,088 B2 * 4/2007 Maruyama ..... H01Q 9/0407 343/700 MS
7,236,070 B2 * 6/2007 Ajioka ..... H01L 23/552 257/E23.114
9,705,174 B2 * 7/2017 Payne ..... H01P 11/006
2003/0146470 A1 * 8/2003 Hijzen ..... H01L 29/872 257/330
2013/0278360 A1 10/2013 Kim et al.
2015/0371832 A1 * 12/2015 Yanai ..... H01L 21/67028 438/714

FOREIGN PATENT DOCUMENTS

EP 2 958 187 A1 12/2015

OTHER PUBLICATIONS

French Search Report for Application No. 1658257 dated May 12, 2017.
Fukuda et al., A 12.5+12.5 Gb/s Full-Duplex Plastic Waveguide Interconnect. IEEE Journal of Solid-State Circuits. Dec. 2011;46(12):3113-25.
Tanaka et al., A Versatile Multi-Modality Serial Link. 2012 IEEE International Solid-State Circuits Comference. Feb. 2012;332-34.
Volkaerts et al., An FSK Plastic Waveguide Communication Link in 40nm CMOS. 2015 IEEE International Solid-State Circuits Conference. Feb. 2015;178-80.
FR 1658257, May 12, 2017, French Search Report.

* cited by examiner

*Primary Examiner* — Huedung X Mancuso
(74) *Attorney, Agent, or Firm* — Wolf, Greenfield & Sacks, P.C.

(57) ABSTRACT

A millimeter-wave waveguide including at least one strip of a dielectric material having a dielectric constant in the range from 1 to 4, a sheath surrounding the strip, and at least four ribs connecting the strip to the sheath.

11 Claims, 1 Drawing Sheet

MILLIMETER-WAVE WAVEGUIDE

This application claims the priority benefit of French patent application number 16/58257, filed on Sep. 6, 2016, the content of which is hereby incorporated by reference in its entirety to the maximum extent allowable by law.

BACKGROUND

The present disclosure relates to a millimeter-wave waveguide made of a dielectric material and a millimeter-wave transmission device comprising such a waveguide.

DISCUSSION OF THE RELATED ART

It is known that millimeter waves can be transmitted in a waveguide made of dielectric plastic material.

FIG. 1 is a diagram showing a millimeter wave transmission system 1 of the type described in the publication entitled "A 12.5+12.5 Gb/s Full-Duplex Plastic Waveguide Interconnect" of Satoshi Fukuda et al. (IEEE Journal of Solid-State Circuits, vol. 46, No. 12, December 2011). Millimeter wave transmission system 1 comprises a waveguide having a rectangular cross-section 3 and made of a dielectric plastic material, two antennas 5 and 5', two millimeter wave transceiver circuits (TX/RX) 7 and 7', and two modulation-demodulation circuits (MOD/DEMOD) 9 and 9'.

Antennas 5 and 5' are located at one of the ends of waveguide 3. Antennas 5 and 5' are for example capable of transmitting and of receiving millimeter waves which propagate through waveguide 3. Antenna 5 is connected to millimeter wave transceiver circuit 7. Similarly, antenna 5' is connected to millimeter wave transceiver circuit 7'. Transceiver circuit 7 is connected to modulation-demodulation circuit 9 and, similarly, transceiver circuit 7' is connected to modulation-demodulation circuit 9'. Modulation-demodulation circuits 9 and 9' are respectively connected to input-output terminals 13 and 13'.

The millimeter waves transmitted by waveguide 3 may be modulated by a binary signal applied to terminal 13 or 13' and demodulated into a binary signal received on terminal 13' or 13.

It would be desirable to be able to simultaneously transmit a plurality of signals over waveguide 3 to increase the data transmission rate.

SUMMARY

Thus, an embodiment provides a millimeter-wave waveguide comprising at least one strip of a dielectric material having a dielectric constant in the range from 1 to 4, a sheath surrounding the strip, and at least four ribs connecting the strip to the sheath.

According to an embodiment, the sheath, the strip and the ribs define cavities filled with a gas, with a gas mixture, with a fluid, or with a solid having a dielectric constant smaller than that of the dielectric material.

According to an embodiment, the ribs are parallel.

According to an embodiment, the waveguide comprises at least two strips of said dielectric material, the sheath surrounding the strips, the ribs connecting the strips to one another and to the sheath.

According to an embodiment, the two strips are parallel.

According to an embodiment, the waveguide is made of a dielectric material having a dielectric constant in the range from 2 to 4.

According to an embodiment, the waveguide is made of a plastic material, particularly polytetrafluoroethylene, polypropylene, or polystyrene.

Another embodiment provides a device for transmitting first millimeter waves comprising a millimeter-wave waveguide such as previously defined and at least four first antennas, each first antenna being capable of transmitting and receiving the first millimeter waves, each end of the waveguide being in contact with two of said first antennas.

According to an embodiment, said two first antennas at each end of the waveguide are distant from each other by a length greater than or equal to a half transmission wavelength of the first antennas.

According to an embodiment, each first antenna has a wavelength in the order of the wavelength of the millimeter waves transmitted by the first antenna.

According to an embodiment, the device comprises at least two second antennas, one of the second antennas being in contact with the waveguide at one of the ends of the waveguide and the other second antenna being in contact with the waveguide at the other end of the waveguide, each second antenna being capable of transmitting and of receiving second millimeter waves, the polarization of the second millimeter waves being perpendicular to within 10% to the polarization of the first millimeter waves.

According to an embodiment, the first millimeter waves have a frequency in the range from 30 GHz to 100 GHz.

The foregoing and other features and advantages will be discussed in detail in the following non-limiting description of dedicated embodiments in connection with the accompanying drawings.

DETAILED DESCRIPTION

Figure 1:
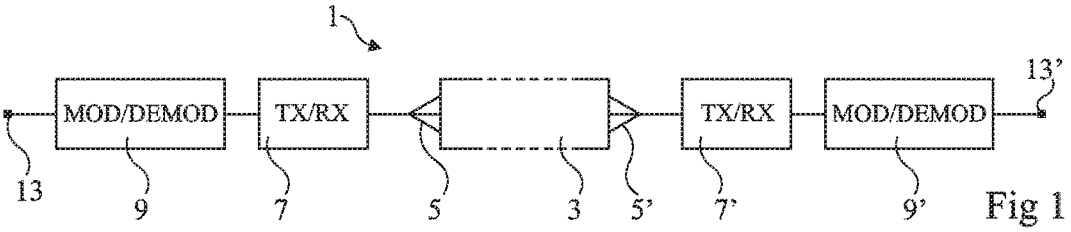
FIG. 1, previously described, is a diagram showing a millimeter-wave transmission system.

The same elements have been designated with the same reference numerals in the various drawings and, further, the various drawings are not to scale. For clarity, only those steps and elements which are useful to the understanding of the described embodiments have been shown and are detailed. In particular, millimeter wave transmit and receive circuits are well known by those skilled in the art and are not described in detail. Unless otherwise specified, expression "in the order of" means to within 10%, preferably to within 5%.

Figure 2:
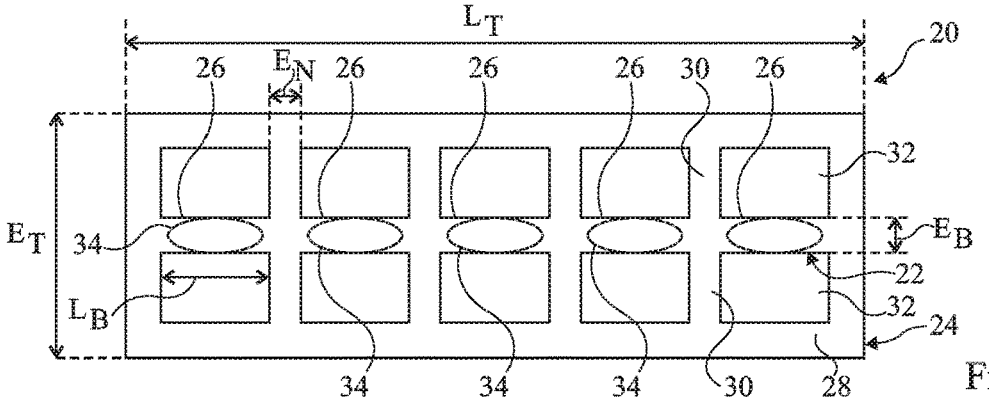
FIG. 2 is a partial simplified cross-section view of an embodiment of a millimeter-wave waveguide.

FIG. 2 is a cross-section view of an embodiment of a waveguide 20.

Waveguide 20 comprises a strip 22 made of a dielectric material held by a support 24. Strip 22 may have a substantially rectangular cross-section. Thickness EB of strip 22 may be in the range from 1 mm to 10 mm. Support 24 is preferably made of the same dielectric material as strip 22. Support 24 may comprise a sheath 28 surrounding strip 22. Sheath 28 may be connected to the lateral ends of strip 22. Support 24 may further comprise ribs 30 connecting sheath 28 to strip 22. In the present embodiment, ribs 30 are substantially parallel. Ribs 30 may extend all along the length of waveguide 20. Ribs 30 may be substantially perpendicular to strip 22. Strip 22, sheath 28, and ribs 30 define cavities 32 which may be filled with a gas or with a gaseous mixture, for example, air. As a variation, cavities 32 may be filled with a liquid or solid material having a dielectric constant smaller than that of the dielectric material forming strip 22.

Strip 22 divides into N different transmission portions 26, N being an integer for example in the range from 3 to 16. Each portion 26 is intended to transmit a millimeter wave. In the embodiment shown in FIG. 2, each transmission portion 26 is located between two adjacent ribs 30. As an example, five portions 26 are shown in FIG. 2. As a variation, each transmission portion 26 may be located at the intersection between strip 22 and ribs 30.

Waveguide 20 may correspond to a monoblock part of a same plastic material. Waveguide 20 may be obtained by molding or by extrusion.

Figure 3:
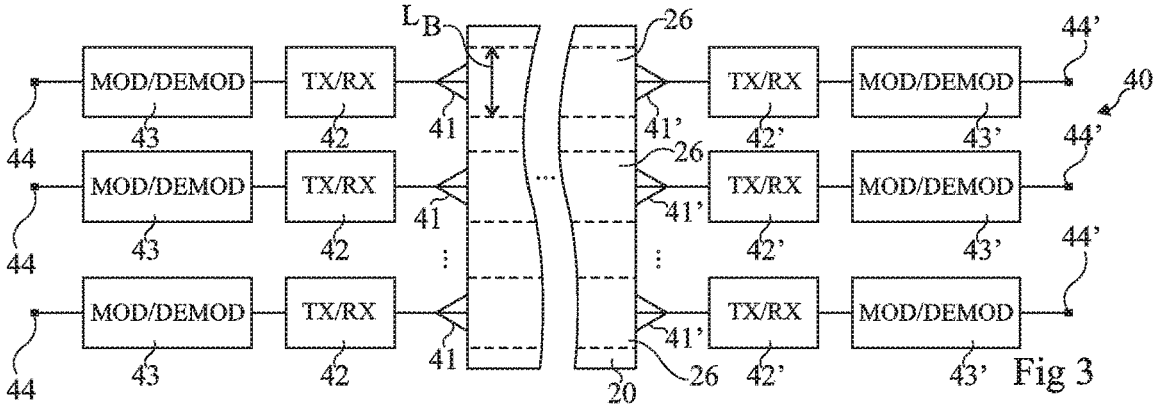
FIG. 3 partially and schematically shows an embodiment of a millimeter wave transmission device comprising the millimeter-wave waveguide of FIG. 2.

FIG. 3 shows an embodiment of a millimeter wave transmission device 40 comprising the waveguide 20 shown in FIG. 2. At each axial end of waveguide 20, transmission device 40 comprises N transceiver antennas 41, 41'. Each antenna 41, 41' is arranged in contact with the axial end of one of transmission portions 26, delimited by dotted lines in FIG. 3. Antennas 41, 41' are for example capable of transmitting and of receiving millimeter waves which propagate through waveguide 20.

According to an embodiment, each antenna 41 is connected to a millimeter wave transceiver circuit 42. Similarly, antenna 41' is connected to a millimeter wave transceiver circuit 42'. Transceiver circuit 42 is connected to a modulation-demodulation circuit 43 and, similarly, transceiver circuit 42' is connected to a modulation-demodulation circuit 43'. Modulation-demodulation circuits 43 and 43' are respectively connected to input-output terminals 44 and 44'. The frequency band of each millimeter wave transmitted through waveguide 20 may be in the range from 30 GHz to 300 GHz.

As a variation, a plurality of antennas 41, 41' may be connected to a same millimeter wave transceiver circuit which is capable of separately processing the signals supplied or received by antennas 41, 41'.

The millimeter waves transmitted by each transmission portion 26 waveguide 20 may be modulated by a binary signal applied to terminal 44 or 44' and demodulated into a binary signal received on terminal 44' or 44.

Preferably, width LB of each transmission portion 26 is greater than or equal to, preferably substantially equal to, the wavelength of the millimeter wave to be transmitted by transmission portion 26. The length of the two antennas located at each end of each transmission portion 26 is in the order of the wavelength of the millimeter wave to be transmitted by transmission portion 26. As an example, the antennas are narrow-band antennas or wide-band antennas. Referring again to FIG. 2, thickness EN of each rib 30 which corresponds to the distance separating, in the plane of the cross-section of waveguide 20, two adjacent transmission portions 26 is for example greater than or equal to half the wavelength of the millimeter waves transmitted by transmission portions 26. The thickness of sheath 28 in the plane of the cross-section of waveguide 20 may further be greater than or equal to half the wavelength of the millimeter waves transmitted by transmission portions 26. Total width LT of waveguide 20 is thus preferably greater than or equal to (3N+1)*LB/2.

The dielectric constant of the dielectric material forming strip 22 of waveguide 20 is for example in the range from 1 to 4, preferably in the range from 2 to 4. The loss angle or tangent delta of the dielectric material forming strip 22 of waveguide 20 is for example smaller than 10-3 to provide minimum losses of the signal in waveguide 20. This material may be a dielectric plastic material such as for example polytetrafluoroethylene, polypropylene, or polystyrene. As an example, for a material having a dielectric constant equal to 2 and for a frequency in the range from 30 GHz to 300 GHz, the wavelength of the electromagnetic waves propagating in transmission portions 26 of waveguide 20 is in the range from 7 mm to 0.7 mm. Waves at a frequency in the order of 60 GHz may for example be used, for which, for a material having a dielectric constant equal to 2, the wavelength is equal to 3.5 mm. For N equal to 5, the total width LT of waveguide 20 is then equal to 28 mm.

In operation, the millimeter waves propagate in waveguide 20 while being substantially confined in transmission portions 26 of strip 22. N signals can thus be simultaneously transmitted. The wavelengths of the millimeter waves used may be identical or different. Areas 34 of confinement of each millimeter wave in waveguide 20 have been schematically shown in dotted lines in FIG. 2. Sheath 28 enables to avoid a direct contact between strip 22 and a user or an object external to waveguide 20.

Figure 4:
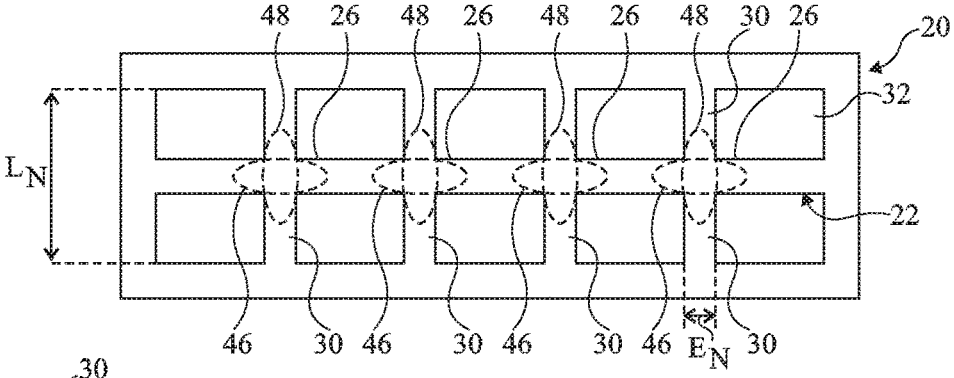
FIGS. 4 and 5 are partial simplified cross-section views of other embodiments of a millimeter-wave waveguide.

FIG. 4 is a cross-section view of waveguide 20, which illustrates another embodiment of a data transmission method where, in addition to the transmission of millimeter waves by transmission portions 26, transceiver antennas are arranged at the ends of waveguide 20 to enable to transmit millimeter waves through ribs 30. According to an embodiment, the polarization of the millimeter waves transmitted in ribs 30 is perpendicular to the polarization of the millimeter waves transmitted in transmission portions 26 of strip 22. In the present embodiment, each rib 30 extends on either side of strip 22. Preferably, width LN, measured in the plane of the cross-section, of each rib 30 is greater than or equal to, preferably substantially equal to the wavelength of the millimeter wave to be transmitted through rib 30. In the embodiment shown in FIG. 4, each transmission portion 26 is located at the intersection between strip 22 and a rib 30.

In operation, the millimeter waves propagate in waveguide 20 while being substantially confined in transmission portions 26 of strip 22 and millimeter waves propagate in waveguide 20 while being substantially confined in ribs 30. The areas 46 of confinement of each millimeter wave in transmission portions 26 and the areas 48 of confinement of each millimeter wave in ribs 30 have been schematically shown in dotted lines in FIG. 4. The polarization of the millimeter waves propagating in ribs 30 being perpendicular to the polarization of the millimeter waves propagating in strip 22, confinement areas 46 and confinement areas 48 may partially overlap. 2N signals can thus be simultaneously transmitted. This enables, as compared with the embodiment illustrated in FIG. 1, to substantially double the transmission rate for a constant frequency band.

In the embodiments shown in FIGS. 2 and 4, waveguide 20 comprises a single strip 22 arranged in sheath 28. As a variation, the waveguide may comprise M strips 22 arranged in sheath 28, where M is an integer greater than or equal to 2.

Figure 5:
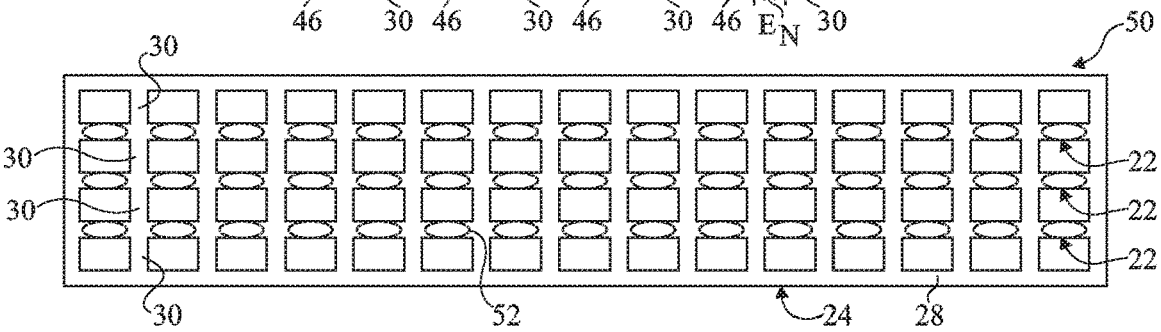

FIG. 5 is a cross-section view of a waveguide 50 in the case where M is equal to 3. The three strips 22 may be substantially parallel. Ribs 30 mechanically connect strips 22 to sheath 28 and strips 22 together. Total thickness ET of waveguide 50 is preferably greater than or equal to (3M+1)*LB/2.

The propagation of the millimeter waves through waveguide 50 may be achieved as previously described in relation with FIG. 2. Each transmission portion 26 of each strip 22 is then located between two adjacent ribs 30. The areas 52 of confinement of each millimeter wave in waveguide 50 in the case where each transmission portion 26 of each strip 22 is located between two adjacent ribs 30 have been schematically shown in dotted lines in FIG. 5. The number of millimeter waves capable of propagating through the waveguide is then equal to N*M.

As a variation, the propagation of the millimeter waves in waveguide 50 may be achieved as previously described in relation with FIG. 4. Millimeter waves are then transmitted in each strip 22 and millimeter waves are transmitted in ribs 30, the millimeter waves transmitted in ribs 30 having a polarization substantially perpendicular to the polarization of the millimeter waves transmitted in strips 22. The number of millimeter waves capable of propagating in the waveguide is then equal to 2*N*M.

According to the previously-described embodiments, the shape of waveguide 20 and 50 is advantageously capable of confining the millimeter waves in the volume internal to sheath 28 to avoid strong signals at the waveguide surface, which enables a user to manipulate the surface of the waveguide.

With the previously-described embodiments of the waveguide, an alternative to a conventional copper-based wire is obtained. The waveguide may be used in any application requiring a high-speed connection, for example between a computing center and a server. Dielectric plastic materials are further less expensive and lighter than copper and do not transmit electromagnetic emissions.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A millimeter-wave waveguide comprising at least one strip, a sheath surrounding the at least one strip, and at least four ribs connecting the at least one strip to the sheath, said at least one strip, said sheath, and said at least four ribs being made of a dielectric material having a dielectric constant in the range from 1 to 4;

wherein the sheath, the at least one strip, and the at least four ribs define cavities filled with a gas, with a gas mixture, with a fluid, or with a solid; each of the gas, the gas mixture, the fluid, and the solid having a dielectric constant smaller than that of the dielectric material, and wherein the at least one strip is configured for propagating electromagnetic waves received from an antenna when the antenna is aligned with the at least one strip.

2. The millimeter-wave waveguide of claim 1, wherein the at least four ribs are parallel.

3. The millimeter-wave waveguide of claim 1, comprising at least two strips of said dielectric material, the sheath surrounding the at least two strips, the ribs connecting the at least two strips to one another and to the sheath.

4. The millimeter-wave waveguide of claim 3, wherein the at least two strips are parallel.

5. The millimeter-wave waveguide of claim 1, wherein the millimeter-wave waveguide is made of a dielectric material having a dielectric constant in the range from 2 to 4.

6. The millimeter-wave waveguide of claim 1, wherein the millimeter-wave waveguide is made of a plastic material, particularly polytetrafluoroethylene, polypropylene, or polystyrene.

7. A device for transmitting first millimeter waves comprising the millimeter-wave waveguide of claim 1 and at least four first antennas, each of the at least four first antennas being capable of transmitting and receiving the first millimeter waves, each end of the millimeter-wave waveguide being in contact with two of said at least four first antennas.

8. The device of claim 7, wherein said two of said at least four first antennas at each end of the waveguide are distant from each other by a length greater than or equal to a half transmission wavelength of the at least four first antennas.

9. The device of claim 7, wherein each of the at least four first antennas has a wavelength in the order of the wavelength of the first millimeter waves transmitted by the first antenna.

10. The device of claim 7, comprising at least two second antennas, one of the at least two second antennas being in contact with the millimeter-wave waveguide at one of the ends of the millimeter-wave waveguide and another second antenna of the at least two second antennas being in contact with the millimeter-wave waveguide at the other end of the millimeter-wave waveguide, each of the at least two second antennas being capable of transmitting and of receiving second millimeter waves having a polarization perpendicular to within 10% to a polarization of the first millimeter waves.

11. The device of claim 7, wherein the first millimeter waves have a frequency in a range from 30 GHz to 300 GHz.

* * * * *